US005484260A

United States Patent [19]

Brandon

[11] Patent Number: 5,484,260

[45] Date of Patent: Jan. 16, 1996

[54] STEAM TURBINE BELL SEALS

[76] Inventor: Ronald E. Brandon, 652 Jubilee St., Melbourne, Fla. 32940

[21] Appl. No.: 488,765

[22] Filed: Jun. 8, 1995

Related U.S. Application Data

[63] Continuation-in-part of Ser. No. 175,522, Dec. 30, 1993, Pat. No. 5,443,589.

[51] Int. Cl.[6] ..... F01D 25/26

[52] U.S. Cl. ..... 415/134; 415/136; 277/236

[58] Field of Search ..... 415/134, 136, 415/138; 277/116.8, 236

[56] References Cited

U.S. PATENT DOCUMENTS

| | | | |
|---|---|---|---|
| 3,907,308 | 9/1975 | Stock | 415/138 |
| 4,032,253 | 6/1977 | Ryncosky et al. | 415/136 |
| 4,802,679 | 2/1989 | Chen | 277/12 |
| 4,812,105 | 3/1989 | Heymann | 415/134 |
| 5,443,589 | 8/1995 | Brandon | 415/134 |

*Primary Examiner*—F. Daniel Lopez
*Assistant Examiner*—Mark Sgantzos
*Attorney, Agent, or Firm*—Ross, Ross & Flavin

[57] ABSTRACT

An improved bell seal arrangement for steam turbines wherein the bell seal is modified by the addition of a special, replaceable, cylindrical extension seal for sealing the leakage gap between the bell seal and the turbine inner shell, the extension seal being threadably attached and secured to the modified bell seal to insure against vibration, and when wear or damage occurs to the extension seal surface, being replaceable without requiring complete removal or replacement of the modified, existing bell seal.

4 Claims, 4 Drawing Sheets

STEAM TURBINE BELL SEALS

CROSS-REFERENCES TO RELATED APPLICATIONS

This is a continuation-in-part of application Ser. No. 08/175,522, filed Dec. 30, 1993 now U.S. Pat. No. 5,443,589.

BACKGROUND OF THE INVENTION

1. Field of the Invention

Steam turbines whose design includes double shell construction require devices that allow the two shells to expand and contract differentially, without allowing significant leakage out of the steam pipes that carry steam from the outer shell to the inner shell.

2. Description of the Prior Art

A common system employed by turbine-manufacturers is called a bell seal. The bell slides into a tube held by the inner shell providing a minimum radial clearance with the tube, yet allowing vertical differential motion of the inner and outer shells. The bell is also secured to a tube held by the outer shell in such a way that it can slide, permitting differential motion in either the lateral or axial directions relative to the shaft, yet maintaining a small clearance that keeps leakage to a minimum.

After service, this bell seal system is commonly found to have a diametrical clearance between the bell and the inner shell tube of about 0.010 inches. This allows significant leakage and loss of turbine output. Replacement of the bell seal is very expensive and often ineffective, with the clearance and leakage recurring.

The major problem is that the bell seal itself is of very powerful construction and when it becomes hot during starting procedures, while the inner shell tube is still relatively cool, its thermal growth can stretch and crush the opposing surfaces on the inner shell tube. Even during steady state operation, the bell may be hotter than the inner shell tube. The described problem is especially apparent on larger turbines where the bell diameter is greater.

Split rings have been used to seal bell seals and reduce leakage, as described by Stock in U.S. Pat. No. 3,907,308. However, such rings lack the frictional and structural resistance that is essential to prevent vibration in the high frequency, fluid turbulance that exists downstream of turbine valves operating at high pressure. Damage to such split rings has occurred to the degree requiring replacement of the bell seal, using the original design rather than the split ring type devised by Stock.

Smith, et al, in U.S. Pat. No. 2,505,217 uses a circular plate to minimize leakage. However, this approach suffers from the following disadvantages:

1. the circular plate is made to lie in one plane and is not formed as a cylinder;
2. the Smith plate has very little resistance to vibration and would not survive in the steam turbine environment of bell seals;
3. the Smith plate operates in an air environment of low fluid velocity, near atmospheric pressure, not in a high pressure steam flow in the range of 2400 to 3500 psia with steam velocities in the range of 1000 fps (feet per second); and
4. the Smith plate is not threaded to its holder, wherefore it is subject to vibration.

An improvement to the bell seal system that prevents crushing the mating surfaces or stretching them beyond the elastic limit while insuring against vibration would provide significant improvement in turbine efficiency. A further improvement would result from a system that provides for replacement of only a portion of the bell seal, thus reducing costs.

SUMMARY OF THE INVENTION

It is the object of the present invention to provide a bell seal system that achieves small leakage clearance in spite of unavoidable thermal gradients.

Another object is to reduce the cost of reestablishing a small clearance should wear or damage occur.

The invention is practiced by providing opposing seal surfaces and materials that permit differential expansion caused by thermal gradients without causing either surface damage or permanent stretching of the walls and sealing components.

This is accomplished by modifying the bell itself to create a replaceable portion of the bell seal in that area of the bell seal which provides a sliding contact surface of the seal with the inner shell tube.

This replaceable seal has several characteristics:

1. it is of relatively thin wall, cylindrical construction to permit yielding without exceeding the elastic limit when thermal expansion causes interference between the tube and the bell seal;
2. it is fabricated from material with a large thermal expansion coefficient, thus permitting clearances for assembly and disassembly, but firm seal contact when hot and running;
3. it is fabricated from material with minimal oxidation tendencies;
4. it is fabricated from material with good ductility at steam turbine initial temperature; and
5. it is threaded to the bell seal to insure against vibration while permitting easy renewal of worn surfaces at minimal cost.

DESCRIPTION OF THE PREFERRED EMBODIMENTS

Figure 1:
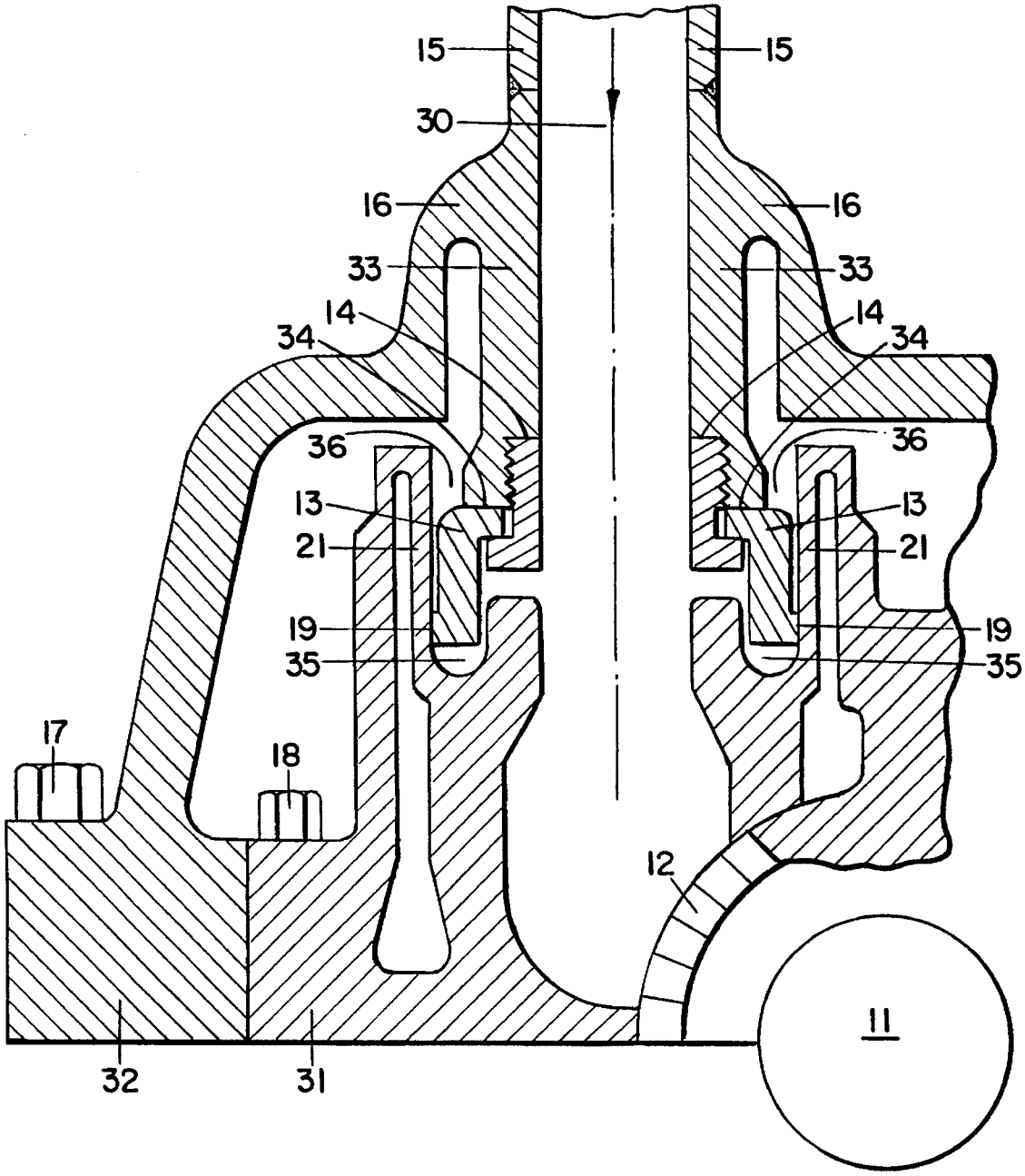
FIG. 1. (PRIOR ART)
FIG. 1 is a fragmentary view of a selected portion of a prior art turbine, partly in section, showing a typical bell seal as currently used in many steam turbines.

Referring to FIG. 1, some of the key elements of the high pressure inlets to a prior art turbine are shown, illustrating current practice. A shaft 11 carries buckets or rotating blades (not shown) that pass circumferentially downstream of nozzles 12. Steam is admitted to the nozzles through a passageway 30 by means of an external pipe 15, connected to an outer shell 16 and to an inner shell 21. Passageway 30 continues to the entrance of the nozzles 12.

The drawing shows only one inlet. In actual practice, a full circle of inlets would include six to eight such inlet passages, each providing steam to a separate section of nozzles.

Inner shell 21 includes nozzles 12, flow passages 30, flange bolts 18, a flange 31 and a cylindrical surface 19 to provide a small clearance seal with a bell seal 13 that is held in an extension of outer shell 16. There are, of course, many other components in the inner shell, but they are not significant to this invention.

Outer shell 16 includes cylindrical tubes or pipes 33 that conduct steam from the outer shell to the inner shell through passage 30. Tubes or pipes 33 also locate bell seal 13 which prevents or minimizes steam leakage from passage 30 into the space between the inner and outer shells. The bell seal is free to move sideways by sliding of a contact surface 34 to facilitate differential motion of the inner and outer shells. The bell seal can slide vertically along seal surfaces 19 to also accommodate differential expansion of the inner and outer shells.

A nut 14 holds the bell seal in proper vertical alignment with the outer shell inlet pipes 33 while allowing any necessary side motion at contact surface 34.

A high pressure zone in the area below bell seal 13 is identified by 35; and a low pressure zone in the area above bell seal 13 is identified by 36.

The outer shell also includes flanges 32 and bolts 17, and is connected to the main steam pipes 15. Other components are also present, but not necessary for this discussion.

Figure 2:
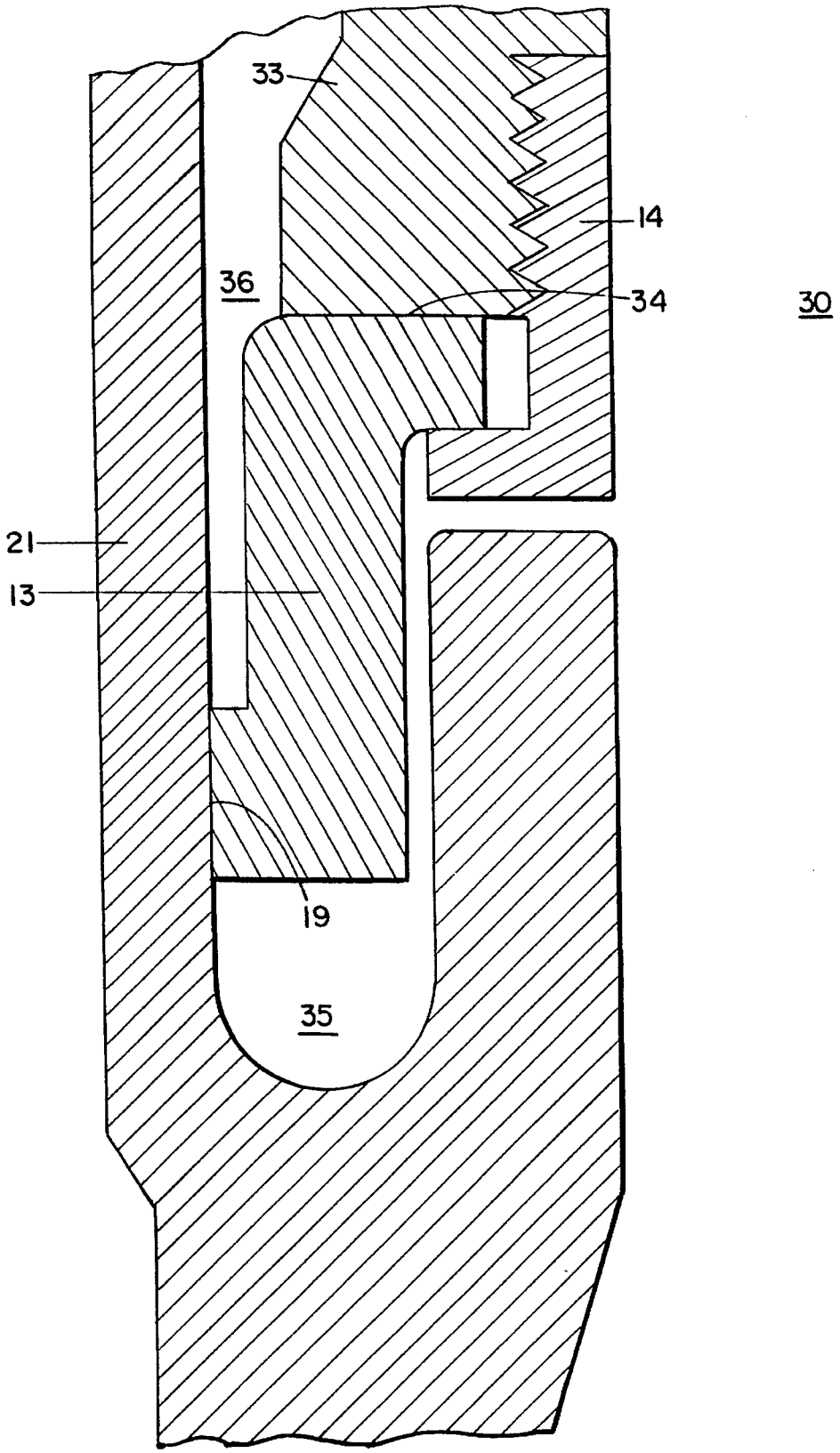
FIG. 2. (PRIOR ART)
FIG. 2 is an enlarged, fragmentary view of a selected portion of the prior art turbine and bell seal of FIG. 1.

FIG. 2 is an enlarged, fragmentary, cross sectional view of a portion of the prior art bell seal of FIG. 1 and the adjacent locating and seal surfaces. As aforesaid, bell seal 13 is secured to outer shell tube 33 by nut 14. The nut is tightened so as to position the bell seal vertically yet not prevent sideways motion at surface 34. The bell seal makes small clearance contact with inner shell 21 at surface 19.

Figure 3:
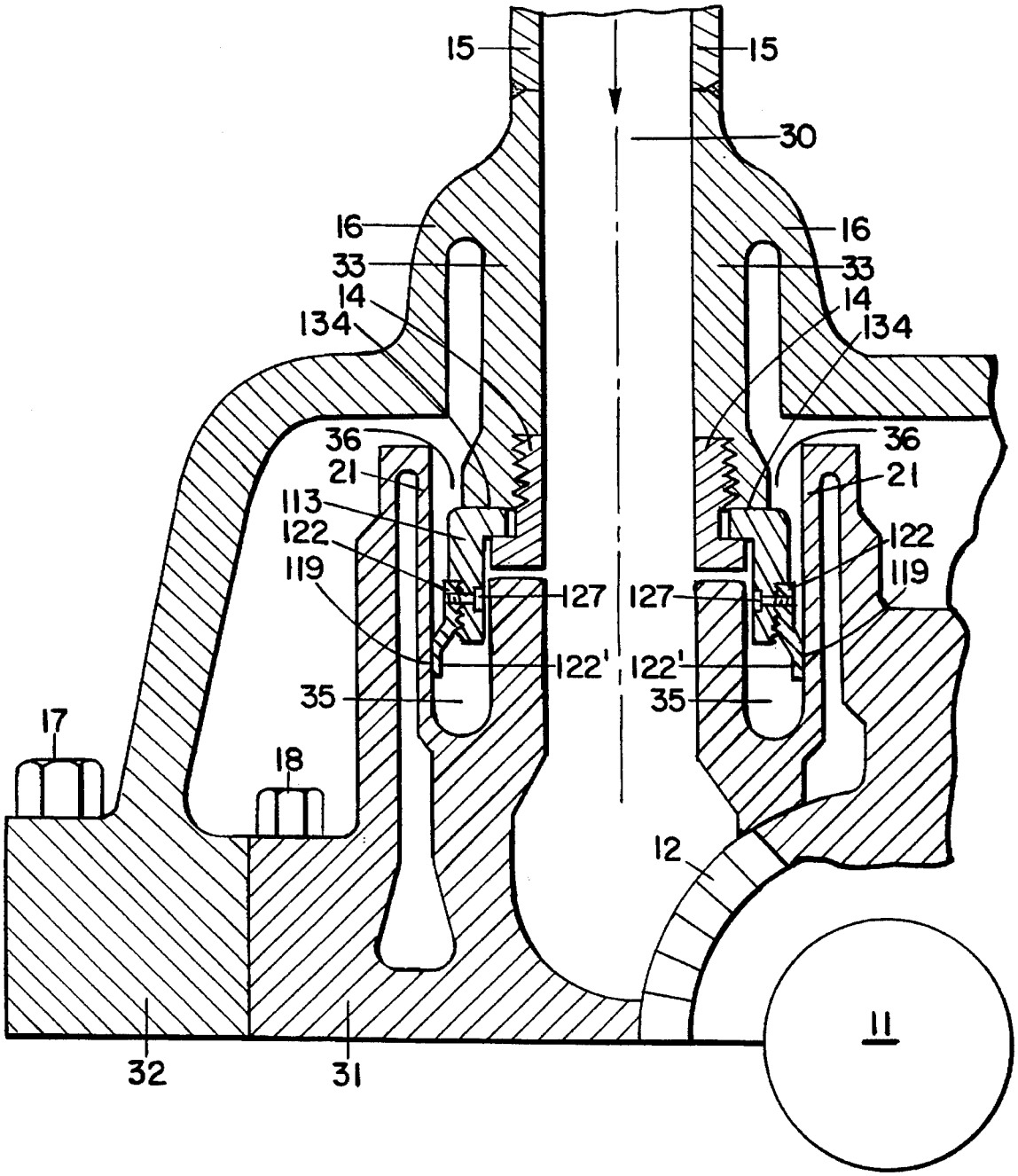
FIG. 3 is a fragmentary view of a selected portion of a turbine, partly in section, showing the seal surfaces for an improved bell seal embodying the invention.

FIG. 3 is a fragmentary cross sectional view of the turbine of FIG. 1, with the bell seal area incorporating improvements in accordance with the preferred form of the invention.

In the turbine of FIG. 3, shaft 11 carries buckets or rotating blades (not shown) that pass circumferentially downstream of nozzles 12. Steam is admitted to the nozzles through passageway 30 by means of external pipe 15, connected to outer shell 16 and to inner shell 21. Passageway 30 continues to the entrance of the nozzles 12.

The drawing shows only one inlet. In actual practice, a full circle of inlets would include six to eight such inlet passages, each providing steam to a separate section of nozzles.

Inner shell 21 includes nozzles 12, flow passages 30, flange bolts 18, flange 31 and a cylindrical surface 119 to provide a small clearance seal with a bell seal 113 that is held in an extension of outer shell 16.

Outer shell 16 includes cylindrical tubes or pipes 33 that conduct steam from the outer shell to the inner shell through passage 30. Tubes or pipes 33 also locate bell seal 113 and a cylindrical seal,extension 122 threaded to the outer lower periphery of the bell seal to prevent or minimize steam leakage from passage 30 into the space between the inner and outer shells by contact at surface 119. The bell seal is free to move sideways by sliding at a contact surface 134 to facilitate differential motion of the inner and outer shells. Bell seal 113 and seal extension 122 can slide vertically along seal surface 119 to also accommodate vertical differential expansion of the inner and outer shells.

Nut 14 holds the bell seal 113 in proper vertical alignment with the outer shell inlet pipes 33 allowing any necessary side motion of contact surface 134.

The outer shell also includes flanges 32 and bolts 17, and is connected to main steam pipes 15. Other components are also present, but not necessary for this discussion.

As with the turbine of FIG. 1, the high pressure zone in the area below bell seal 113 is identified by 35; and the low pressure zone in the area above bell seal 113 is identified by 36.

Figure 4:
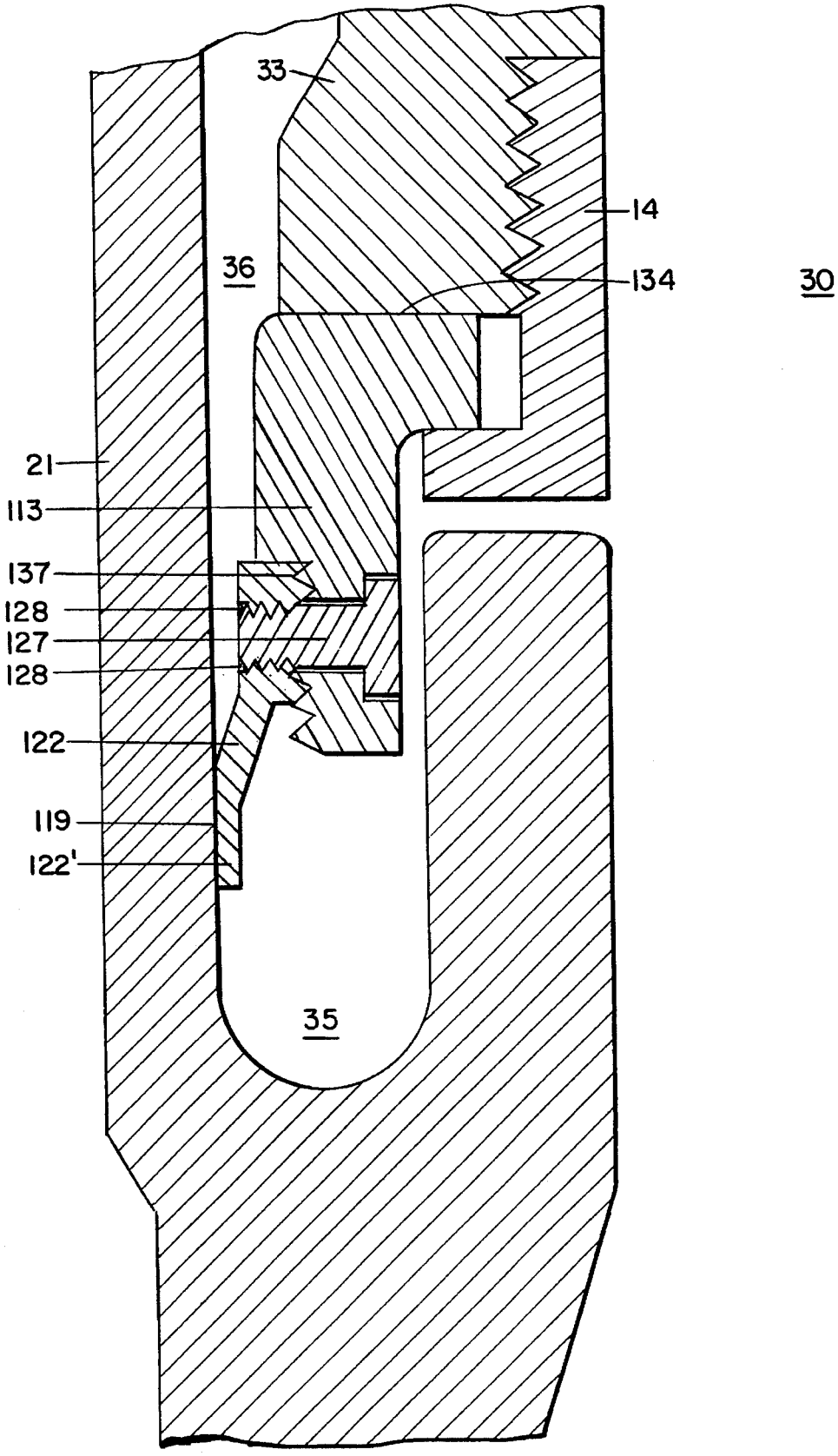
FIG. 4 is an enlarged, fragmentary view of a selected portion of the turbine and bell seal of FIG. 3.

As best seen in FIG. 4, which is an enlarged, fragmentary cross sectional view of the bell seal area of FIG. 3 with improvements in accordance with the invention the outer, lower periphery of bell seal 113 is machined to provide a threaded attachment 137 between the bell seal and the upper end of cylindrical seal extension 122, which has an integral skirt 122' which depends from the bell seal to provide a circular seal with inner shell 21 at surface 119, thereby minimizing leakage from passage 30 into space 36 between the inner and outer shells, while insuring against vibration.

Seal extension 122 is preferably relatively thin to increase its flexibility and to permit radial motion when the bell seal is enlarged relative to the inner shell due to the hotter condition of the bell seal and seal extension 122.

A locking bolt 127 extends transversely through the lower end of bell seal 113 and is threadedly-engaged with seal extension 122 to preclude rotation of the seal extension during turbine operation.

Locking bolt 127 is preferably secured in place by means such as weld beads 128.

It should be noted that the materials of seal extension 122 as well as of the inner shell surface 119 respectively, must tolerate the combination of both steady state and transient stress and temperature without exceeding the elastic limit or creeping.

As mentioned previously, existing bell seals are especially vulnerable to rapid heating during cold starts. They are directly exposed to the hot incoming steam and get hot quicker than the portion of the inner shell which surrounds them. That portion Of the inner shell not only is not directly exposed to the high velocity steam, it also has cooler steam on the opposite side of the wall from that which faces the bell at seal surface 19 as seen in FIG. 1 and at seal surface 119 as seen in FIG. 3.

In addition, during light load operation, the temperature difference of the bell seal and shell will be somewhat greater than when operating at full load. Since the original bell seal is very strong in construction, it tends to force the opposing wall at surface 19 or 119 to be stretched, leading to enlargement caused by creep as well as surface damage.

Beyond the temperature effects, this area of the turbine is subjected to high frequency pressure fluctuations which tend to vibrate any components which have freedom of motion. Split piston rings, which are sometimes used to provide seal surfaces for the bell seal, have shown obvious troubles due to vibration. Even bell seals have the capability to vibrate and batter the inner shell seal surface once some clearance has been created.

The invention hereof resolves these problems. In FIGS. 3 and 4, seal extension 122 is a relatively thin cylinder that can be expanded by increasing temperature without causing either very large surface forces or internal stress. This reduces the tendency for creep and surface damage. Further, the seal extension is strongly secured and has reduced vulnerability to vibration. By keeping a neat fit against both the bell seal and the inner shell, it also tends to restrict vibration of the bell itself.

A further improvement in assurance of a good seal at 119 can be obtained by making the seal extension of a material with a large thermal coefficient of expansion, such as A 286. In this way, the cold assembly and disassembly condition would be a clearance at surface 119. The clearance could be designed to disappear at a selected temperature, say 700° F., which would exist at very low turbine load when vibration forces are small. As the load and temperature increase, the sealing force would increase, but not to a degree to cause undesirable creep or,surface deterioration. This enables the gap to be sealed or reduced even where vibration or wear might have caused some surface damage on extension seal 122 or the inner shell at surface 119.

In the unlikely event of wear or distortion of seal extension 122, it may be easily removed from the bell seal by removal of locking bolt 127, whereupon the seal extension may be unthreaded from the bell seal and replaced by a new seal extension, thereby avoiding the high expense of replacing the bell seal.

I claim:

1. In a turbine employing a double shell construction of inner and outer shells and bell seals having sealing engagement with the inner shell, the improvement comprising a replaceable, cylindrical extension seal threadedly engaged with each bell seal and having a sealing surface in sealing engagement with the inner shell, the extension seal being replaceable when wear or damage occurs to its sealing surface thereby avoiding replacement of the bell seal.

2. In a turbine according to claim 1, wherein the extension seal is secured against rotation relative to the bell seal by a locking bolt.

3. In a turbine according to claim 1, wherein the extension seal is fabricated from material with a large coefficient of expansion, wherefore for cold conditions, such as at assembly, a small clearance with the shell exists, said clearance persisting until the temperature of the components approaches a moderate temperature such as 700° F., with further increase causing increased tightness of the sealing surface of the extension seal with the inner shell

4. In a turbine according to claim 3, wherein the extension seal is fabricated from A286 steel.

* * * * *